US006286713B1

(12) United States Patent
Chan et al.

(10) Patent No.: US 6,286,713 B1
(45) **Date of Patent: *Sep. 11, 2001**

(54) DISPENSING SYSTEM FOR INDIVIDUAL FOLDED WEBS

(75) Inventors: Michael Yuwah Chan; Paul Francis Tramontina, both of Alpharetta, GA (US)

(73) Assignee: Kimberly-Clark Worldwide, Inc., Neenah, WI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/816,288

(22) Filed: Mar. 13, 1997

(51) Int. Cl.[7] ..... A47K 10/24; B65H 1/00

(52) U.S. Cl. ..... 221/49; 221/33; 221/48; 221/63

(58) Field of Search ..... 221/49, 35, 45, 221/33, 48, 50, 60, 65, 63

(56) References Cited

U.S. PATENT DOCUMENTS

| | | | |
|---|---|---|---|
| 548,260 | 10/1895 | Lucas . | |
| 1,122,108 | 12/1914 | Hamilton . | |
| 1,151,064 | 8/1915 | Swift . | |
| 1,158,550 | 11/1915 | Parsons . | |
| 1,177,466 | 3/1916 | Winter . | |
| 1,511,812 | 10/1924 | Horwitt . | |
| 1,582,645 | 4/1926 | Findley . | |
| 1,681,639 | 8/1928 | Hansen . | |
| 1,697,654 | 1/1929 | Jantzen . | |
| 1,706,166 | 3/1929 | Hunt . | |
| 1,723,734 | 8/1929 | Jordan . | |
| 1,993,885 | 3/1935 | Horwitt | 312/61 |
| 2,002,691 | 5/1935 | Cofrin | 206/57 |
| 2,195,622 | 4/1940 | Fourness et al. | 206/57 |
| 2,244,630 | 6/1941 | Metternich | 206/57 |
| 2,382,368 | 8/1945 | Mitchell | 206/56 |
| 2,433,587 | 12/1947 | Wentworth | 312/50 |
| 2,477,223 | 7/1949 | West | 206/57 |
| 2,689,059 | 9/1954 | Nudell | 220/41 |
| 2,765,909 | 10/1956 | Graham | 206/57 |
| 2,852,158 | 9/1958 | Jones et al. | 221/35 |
| 2,858,044 | 10/1958 | Schadenburg | 221/46 |
| 2,933,431 | 4/1960 | Sperouleas | 167/84 |
| 2,953,293 | 9/1960 | Anderson | 229/51 |

(List continued on next page.)

FOREIGN PATENT DOCUMENTS 178495 7/1935 (CH) .

*Primary Examiner*—Christopher P. Ellis
*Assistant Examiner*—Gene O. Crawford
(74) *Attorney, Agent, or Firm*—Scott B. Garrison; Dority & Manning

(57) ABSTRACT

A dispensing system for individual folded webs having an area of non-uniform thickness across the length of the web is composed of several components. An outer housing defines an interior space in which stacking means for holding a stack of individual folded webs are mounted. A dispensing face is defined in the outer housing proximate to an end of the stacking means. The dispensing face has a central portion projecting out from the dispenser in the form of a first surface and a second surface joined at an obtuse angle and a dispensing throat located in the central portion at about the intersection of the first and second surfaces. The dispensing system also includes a stack of individual folded webs having an area of non-uniform thickness across the length of the web aligned so that an area of greatest thickness extends across the width of the dispensing throat. At least one recessed section along at least one edge of the dispensing throat contacts the stack of individual folded webs so that a portion of the stack of individual folded webs projects outward from the dispensing throat.

20 Claims, 7 Drawing Sheets

U.S. PATENT DOCUMENTS

| | | | |
|---|---|---|---|
| 3,119,516 | 1/1964 | Donovan | 221/47 |
| 3,121,510 | 2/1964 | Holzwarth et al. | 221/60 |
| 3,203,586 | 8/1965 | Downham | 221/55 |
| 3,249,255 | 5/1966 | Cohen | 221/63 |
| 3,589,555 | 6/1971 | Burkhalter | 221/35 |
| 3,624,791 | 11/1971 | Taub | 221/59 |
| 3,684,086 | 8/1972 | Harrison | 206/46 |
| 3,754,681 | 8/1973 | Slye et al. | 221/45 |
| 3,982,685 | 9/1976 | Shimada | 229/51 |
| 4,143,762 | 3/1979 | Spiegelberg | 206/210 |
| 4,181,225 | 1/1980 | Spiegelberg | 206/494 |
| 4,191,307 | 3/1980 | LeCaire et al. | 221/45 |
| 4,289,262 | 9/1981 | Finkelstein | 225/106 |
| 4,411,374 | 10/1983 | Hotchkiss | 211/63 |
| 4,453,649 | 6/1984 | Origuchi | 221/26 |
| 4,679,703 | 7/1987 | De Luca | 221/52 |
| 4,781,306 | 11/1988 | Smith | 221/33 |
| 4,848,575 | 7/1989 | Nakamura et al. | 206/449 |
| 4,896,773 | 1/1990 | Zilio | 206/494 |
| 4,953,746 | 9/1990 | Andriash | 221/35 |
| 4,953,747 | 9/1990 | Wenkman et al. | 221/45 |
| 4,969,575 | 11/1990 | Kobayashi | 221/45 |
| 5,074,430 | 12/1991 | Roberts | 221/44 |
| 5,076,466 | 12/1991 | Petterson et al. | 221/46 |
| 5,090,592 | 2/1992 | Petterson et al. | 221/55 |
| 5,100,020 | 3/1992 | Petterson et al. | 221/45 |
| 5,102,007 | 4/1992 | Petterson et al. | 221/6 |
| 5,137,173 | 8/1992 | Hughes et al. | 221/34 |
| 5,165,570 | 11/1992 | Windorski et al. | 221/46 |
| 5,219,092 | 6/1993 | Morand | 221/53 |
| 5,332,118 | 7/1994 | Muckenfuhs | 221/48 |
| 5,368,188 | 11/1994 | Twardowski | 221/50 |
| 5,497,903 | 3/1996 | Yoneyama | 221/48 |
| 5,516,001 | 5/1996 | Muckenfuhs et al. | 221/63 |
| 5,520,308 | 5/1996 | Berg et al. | 221/50 |
| 5,524,759 | 6/1996 | Herzberg et al. | 206/494 |
| 5,531,325 | 7/1996 | Deflander et al. | 206/494 |
| 5,540,332 | 7/1996 | Kopacz et al. | 206/494 |
| 5,562,258 | 10/1996 | McConnell et al. | 428/122 |
| 5,607,754 | 3/1997 | Giles | 428/211 |
| 5,613,608 | 3/1997 | Tronchetti et al. | 206/494 |
| 5,630,511 | 5/1997 | Bose | 206/555 |

DISPENSING SYSTEM FOR INDIVIDUAL FOLDED WEBS

FIELD OF THE INVENTION

This invention generally relates the field of dispensing devices and systems. More particularly, this invention relates to the field of devices and systems for dispensing folded sheets of material.

BACKGROUND

Dispensers for individual folded webs such as paper napkins are often provided at quick service food locations. One disadvantage of many conventional paper napkin dispensers is that they often provide rather poor one-at-a-time dispensing of folded napkins. Such inadequate one-at-a-time dispensing can be particularly noticeable if the napkins are individual folded napkins (e.g., conventional overfold napkins) instead of interfolded napkins. Another disadvantage is that many conventional overfold napkin dispensers often permit removal of large clumps of napkins at one time. Studies have shown most paper napkins removed in this manner are wasted. Many end up scattered about an eating area, tossed as litter or, even worse, being stuffed in plumbing fixtures. When clumps of napkins are taken, dispensers quickly run out and must be refilled inconveniencing both customers and operators of quick service food locations.

A conventional overfold paper napkin 10 typically has a closed end 12 that is defined by a main panel 14 of absorbent paper material and an open end 16 that is defined by second panel 18. An optional third panel 20 may be folded under the second panel 18. The second and third panels 18, 20 are unitary with main panel 14, and are, respectively, connected to main panel 14 at fold lines that are at opposite ends of main panel 14, as may be seen in FIG. 1. A conventional paper napkin may be made of a single ply or a multiple ply material. For example, FIG. 1 shows a two ply material having a first ply 22 and a second ply 24.

One common problem with conventional overfold paper napkins may be seen in reference to FIGS. 2A and 2B. Conventional overfold paper napkins are designed to be stacked in a napkin dispenser 26 such as, for example, a spring loaded napkin dispenser or a gravity feed dispenser. Such napkin dispensers have an opening 28 so that the open end 16 of the napkin 10 faces the opening 28 as shown in FIG. 2A. In this position, a user can grab the second panel 18 to pull the napkin 10 out of the dispenser 26. However, when stacked improperly, as shown in FIG. 2B, with the closed end 12 facing the opening 28, dispensing is awkward, and often results in wastage. Not uncommonly, maintenance personnel will stack overfold paper napkins improperly, as shown in FIG. 2B rather than as shown in FIG. 2A.

Moreover, conventional overfold paper napkins are two to three times as thick where the second panel 18 and the optional third panel 20 are folded over the main panel 14. When such paper napkins are arranged in a stack, the stack will have its greatest thickness across an upper or lower edge 30 of the opening 28 in the dispenser 26 as seen in FIG. 3. Pressure generated by a spring-loaded dispenser or an overfilled dispenser will force the thickest portion of the stack against the edge 30 of the dispenser 26. If sufficient pressure exists, friction between the edge 30 of the dispenser 26 and the outermost paper napkin will make it difficult to remove a napkin from the dispenser.

A long and unfilled need exists for a dispensing system that provides satisfactory one-at-a-time dispensing for individual folded webs. This unfilled need extends to a dispensing system for individual folded webs that will deter and resist wasteful dispensing.

SUMMARY OF THE INVENTION

The problems and needs described above are addressed by the present invention which provides a dispensing system for individual folded webs having an area of non-uniform thickness across the length of the web from a stack of such individual folded webs. The dispensing system is composed of: (a) an outer housing defining an interior space; (b) stacking means mounted within the outer housing for holding a stack of individual folded webs within the interior space; (c) a dispensing face defined in the outer housing proximate to an end of the stacking means, the dispensing face defining a dispensing throat; (d) a stack of individual folded webs having an area of non-uniform thickness across the length of the web; and (e) at least one recessed section along at least one edge of the dispensing throat which contacts the stack of individual folded webs so that a portion of the stack of individual folded webs projects outward from the dispensing throat.

According to the invention, the dispensing face has a central portion projecting out from the dispenser in the form of a first surface and a second surface joined at an obtuse angle. The dispensing throat is located in the central portion at about the intersection of the first and second surfaces.

One feature of the invention is that the stack of individual folded webs having an area of non-uniform thickness across the length of the web is aligned so that an area of greatest thickness extends across the width of the dispensing throat.

In an embodiment of the invention, the stacking means may be composed of at least one restricting rib positioned against the stack of individual folded webs to maintain alignment of the stack so that the area of greatest thickness extends across the width of the dispensing throat during dispensing. For example, two or more restricting ribs may be positioned against the stack of webs so that displacement of the stack is minimized during dispensing which helps maintain proper alignment of the stack of webs. The restricting ribs may be mounted on an interior surface of the outer housing. Desirably, the restricting ribs are positioned so the run longitudinally along the stack of webs.

In another embodiment of the invention, the dispensing system may also include a staging area proximate the dispensing throat for spacing and slowing individual folded webs as they approach the dispensing throat. The staging area may include at least two curved bumpers oriented so as to be parallel to the path of travel of the individual folded webs as they approach the dispensing throat. A number of ribs, ridges, nobs or the like may be defined on the bumpers for temporarily arresting movement of the individual folded webs as they approach the dispensing throat.

According to the invention, the stack of individual folded webs contains individual webs composed of: (a) a first, central panel; (b) a second panel, unitary with said first panel and folded over a first side of said first panel; (c) a third panel, unitary with the first panel, and folded over a second side of the first panel; (d) a fourth panel, unitary with the second panel, and folded so as to be positioned between the first and second panels; and (e) a fifth panel, unitary with the third panel, and folded so as to be positioned between the first and third panels, such that a portion of the third panel and fifth panel overlap a portion of the second panel and fourth panel generating an area of non-uniform thickness across the length of the web. The stack of individual folded webs may be a stack of fibrous webs. Desirably, the stack of folded webs is a stack of absorbent paper webs such as, for example, absorbent paper napkins.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying description of the invention.

DETAILED DESCRIPTION

Figure 4:
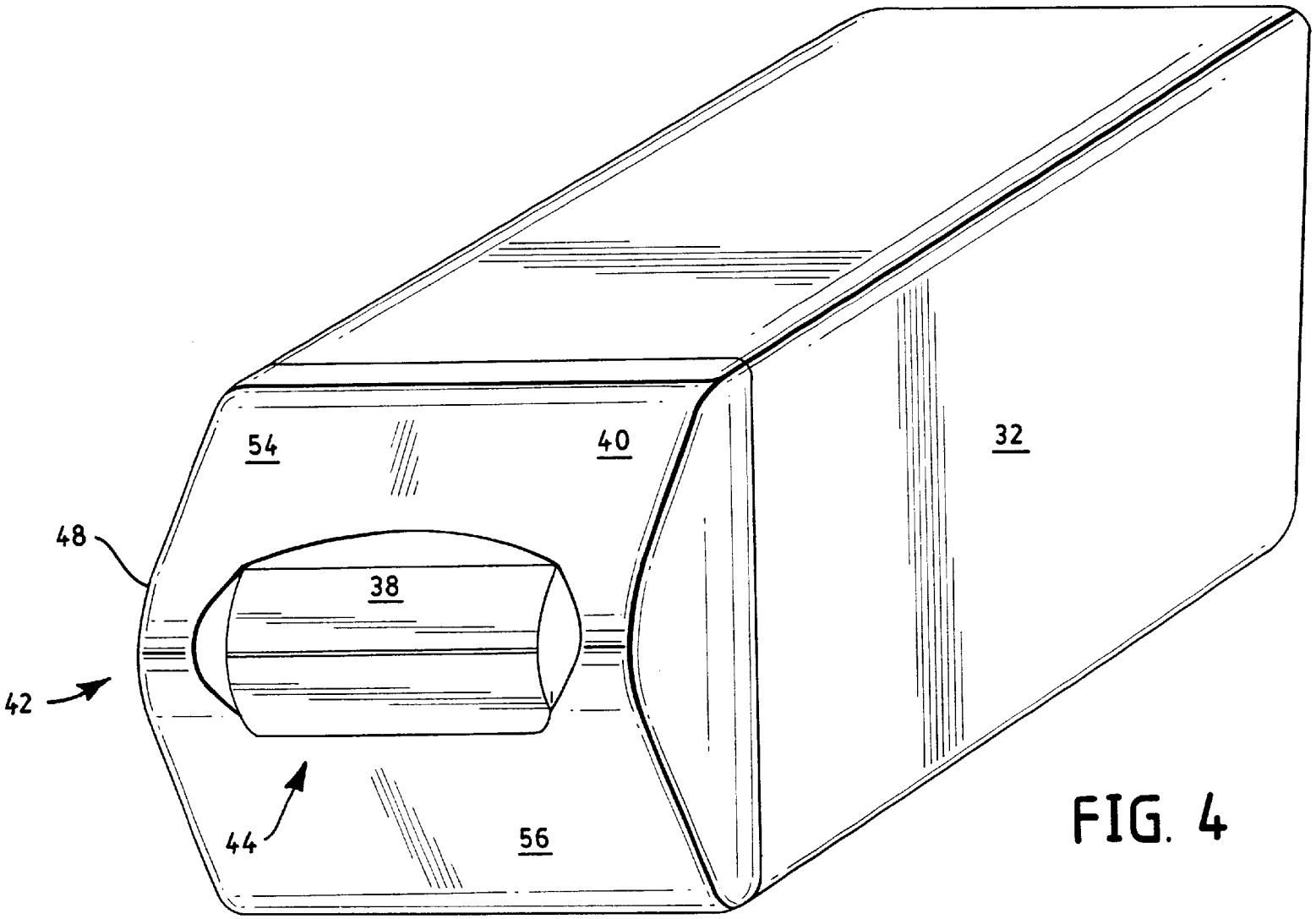
FIG. 4 is a perspective view illustration of an exemplary dispensing system for individual folded webs.
Figure 5:
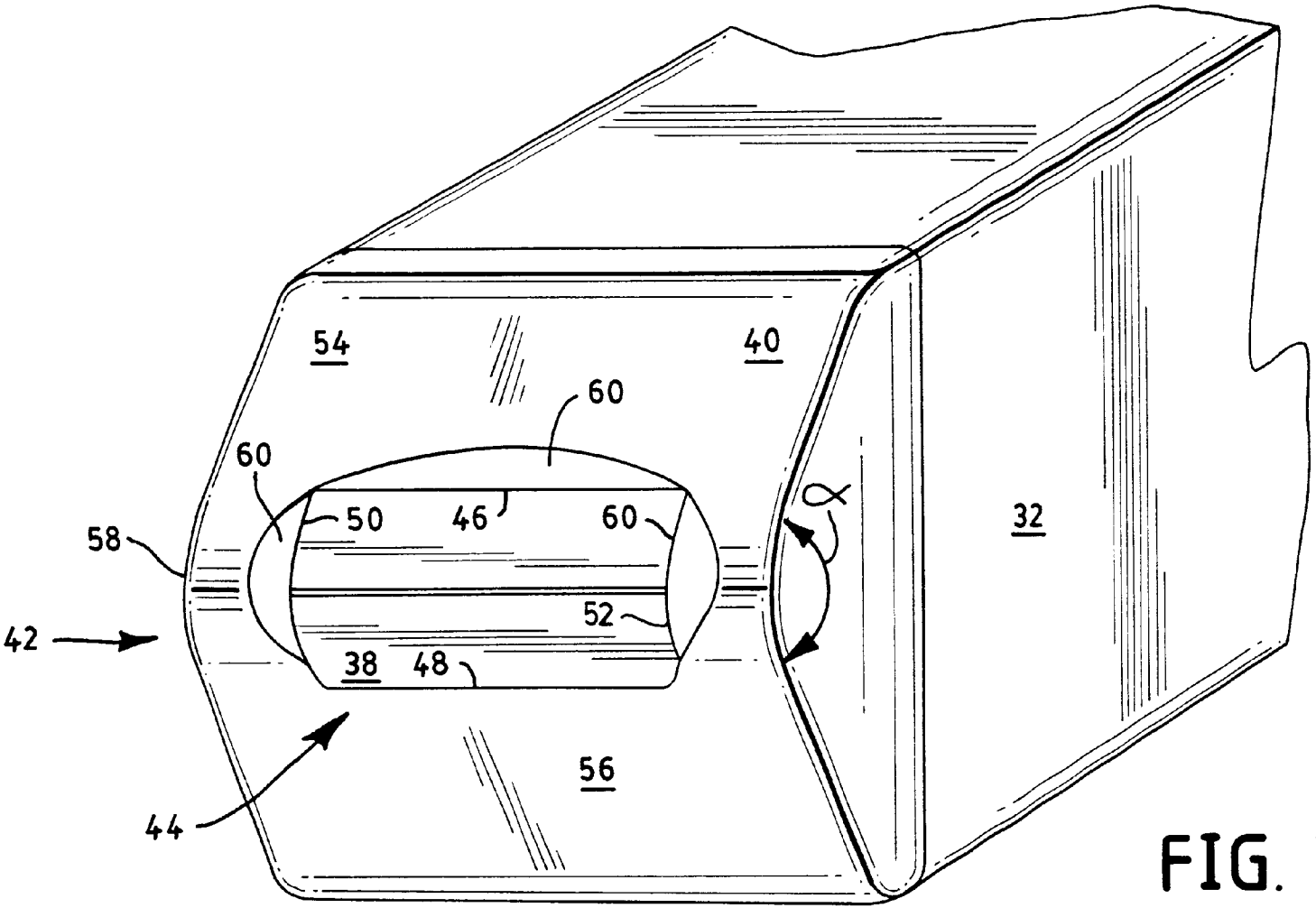
FIG. 5 is an illustration of a detail of an exemplary dispensing system for individual folded webs.

Referring now to the drawings, wherein like reference numerals designate corresponding structure throughout the views, and referring in particular to FIGS. 4 and 5, there is shown an exemplary dispensing system. The system includes an outer housing 32 defining an interior space 34 that contains a stacking means 36 (shown in FIG. 6) which is mounted within the outer housing 32 for holding a stack of individual folded webs (e.g., paper napkins) 38 of the type herein described within the interior space 34.

The system also includes a dispensing face 40 defined in the outer housing 32 proximate to an end of the stacking means 36.

The dispensing face 40 has a central portion 42 projecting out from the outer housing 32 and a dispensing throat 44 located in the central portion 42. The dispensing throat 44 is defined by the edges of the dispensing face and should have a width that is slightly less than the width of the individual folded web (e.g., paper napkin) that is to be dispensed. The dispensing throat 44 has a top edge 46, a bottom edge 48, a first side edge 50 and a second side edge 52.

Referring now to FIG. 5, it can be seen that the central portion 42 of the dispensing face 40 projects out from the outer housing 32 of the dispenser. The central portion 42 of the dispensing face 40 projects out in the form of a first surface 54 and a second surface 56 joined at an obtuse angle a (i.e., greater than 90 and less than 180 degrees). The dispensing throat 44 should be located at about the intersection 58 of the first and second surfaces 54, 56 where there is a crease or break in the plane of the dispensing face 40. It is contemplated that other configurations of the dispensing face which provide a suitable crease or break in the plane of the dispensing face at the dispensing throat may be used.

Generally speaking, the angle $\alpha$ may range from about 175 degrees to about 160 degrees to provide a crease or break in the plane of the dispensing face. For example, the angle $\alpha$ may range from about 173 degrees to about 162 degrees. As another example, the angle a may range from about 170 degrees to about 165 degrees.

One feature of the present invention is the one or more recessed sections 60 along at least one edge of the dispensing throat which contacts the stack of individual folded webs so that a portion of the stack of individual folded webs projects outward from the dispensing throat. These recessed sections 60 are desirably located along the top edge 46, first side edge 50, and the second side edge 52 of the dispensing throat 44 which contact the stack of individual folded webs and should have dimensions such that a portion of the stack of individual folded webs projects outward from the dispensing throat.

By pressing against the stack of individual folded webs, the recessed portions 60 located at the first side edge 50 and the second side edge 52 also make it more difficult for a consumer to insert one or more fingers into the dispensing throat to grasp a clump of webs. Accordingly, wasteful dispensing of the folded webs is reduced.

Figure 6:
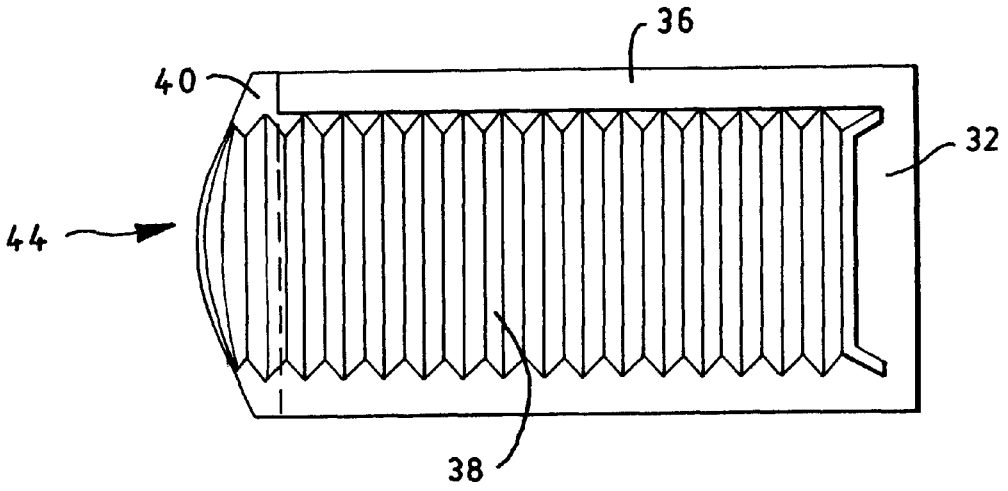
FIG. 6 is an illustration of a detail of an exemplary dispensing system for individual folded webs.

Referring now to FIG. 6, the dispensing system includes a stacking means 36 which may be composed of at least one restricting rib positioned against the stack of individual folded webs 38 to maintain alignment of the stack so that the area of greatest thickness extends across the width of the dispensing throat 44 during dispensing. For example, two or more restricting ribs may be positioned against the stack of webs so that displacement of the stack is minimized during dispensing which helps maintain proper alignment of the stack of webs. The restricting ribs may be mounted on an interior surface of the outer housing. Desirably, the restricting ribs are positioned so they run along the stack of webs (e.g., longitudinally).

Figure 7:
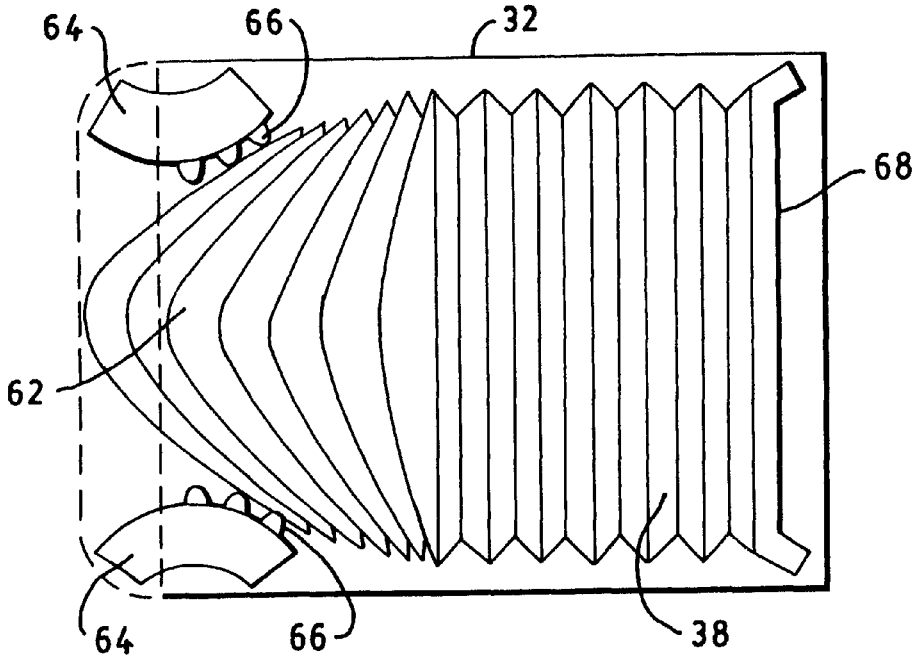
FIG. 7 is an illustration of a detail of an exemplary dispensing system for individual folded webs.

In an embodiment of the invention, the dispensing system may include a staging area proximate the dispensing throat for spacing and slowing napkins as they approach the dispensing throat. Referring now to FIG. 7, the staging area 62 may be composed of at least two bumpers 64 oriented so as to be parallel to the path of travel of the napkins as they approach the dispensing throat, and a number of ribs 66 defined on the bumpers 64 for temporarily arresting movement of the napkins as they approach the dispensing throat.

The bumpers 64 , in combination with a spring loaded plate 68 that pushes against the stack of napkins 38, may enhance the action of the recessed portions 60 of the dispensing throat 44 causing the napkins to bow out or buckle into the dispensing throat 44. Such a configuration is believed to aid dispensing of the napkins by causing the napkins to feed into the dispensing throat 44 relatively uniformly and relatively independent of how full the dispenser is during dispensing. The bumpers also assist the stacking means 36 in centering the napkins on the dispensing throat to reduce the likelihood that napkins will drag against an end of the dispensing slot creating friction that may tear a napkin and interrupt dispensing.

According to the invention, the dispensing system is designed to work with a stack of individual folded webs instead of overfolded webs or interfolded webs. The stack of individual folded webs may be a stack of fibrous webs. Desirably, the stack of folded webs is a stack of absorbent webs such as, for example, an absorbent nonwoven product. More desirably, the stack of folded webs is a stack of absorbent paper webs such as, for example, paper napkins, paper towels, tissues or the like.

The individual folded webs are composed of: (a) a first, central panel; (b) a second panel, unitary with said first panel and folded over a first side of said first panel; (c) a third panel, unitary with the first panel, and folded over a second side of the first panel; (d) a fourth panel, unitary with the second panel, and folded so as to be positioned between the first and second panels; and (e) a fifth panel, unitary with the third panel, and folded so as to be positioned between the first and third panels, such that a portion of the third panel and fifth panel overlap a portion of the second panel and fourth panel generating an area of non-uniform thickness across the length of the web.

Figure 1:
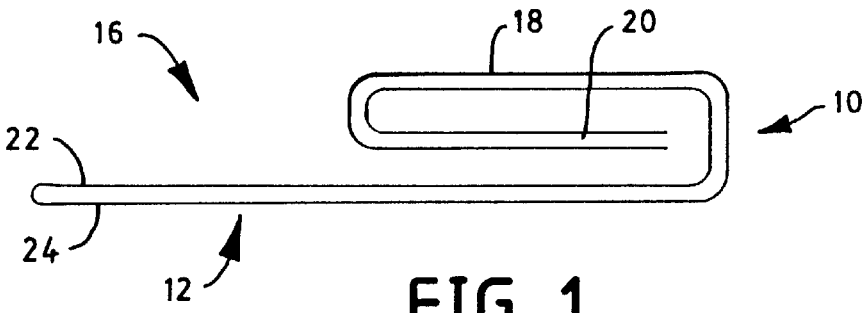
FIG. 1 is a cross sectional depiction of a conventional overfold type dispensable web.
Figure 2A:
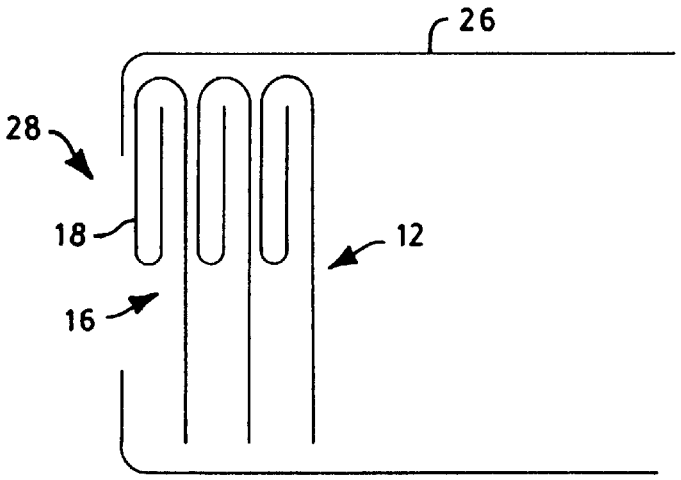
FIG. 2A is an illustration of a properly loaded dispenser containing a conventional overfold type dispensable web.
Figure 2B:
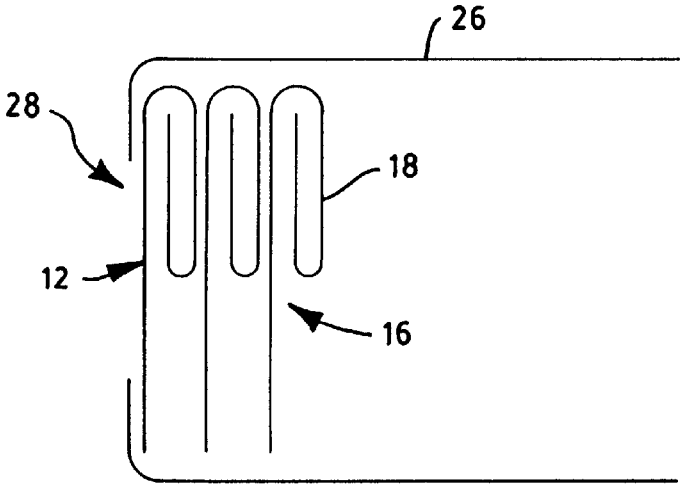
FIG. 2B is an illustration of an improperly loaded dispenser containing a conventional overfold type dispensable web.
Figure 3:
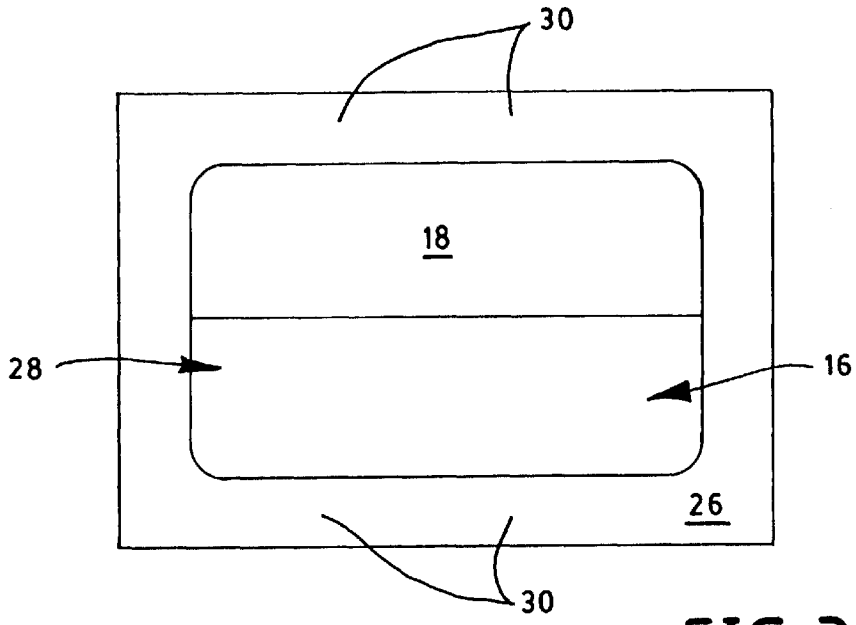
FIG. 3 is a front view illustration of a dispenser containing a conventional overfold type dispensable web.
Figure 8:
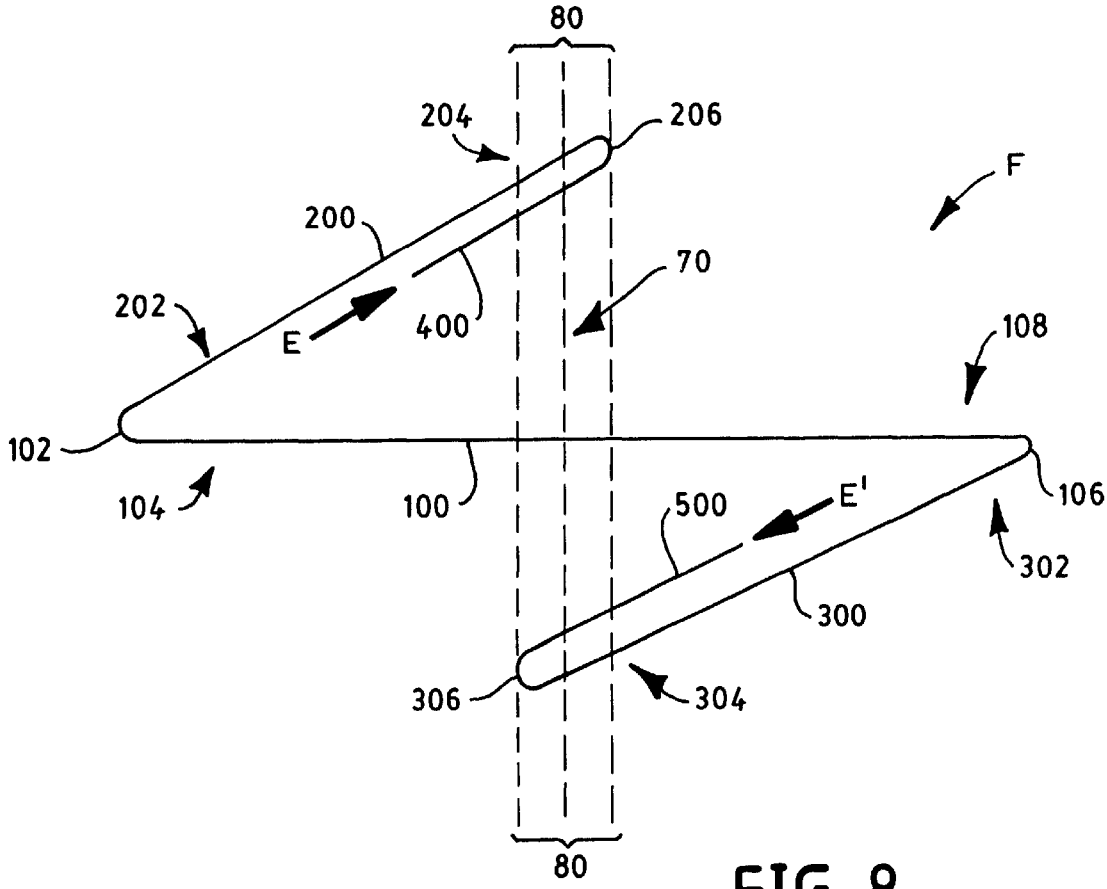
FIG. 8 is an illustration of a cross section of an exemplary individual folded web.
Figure 9:
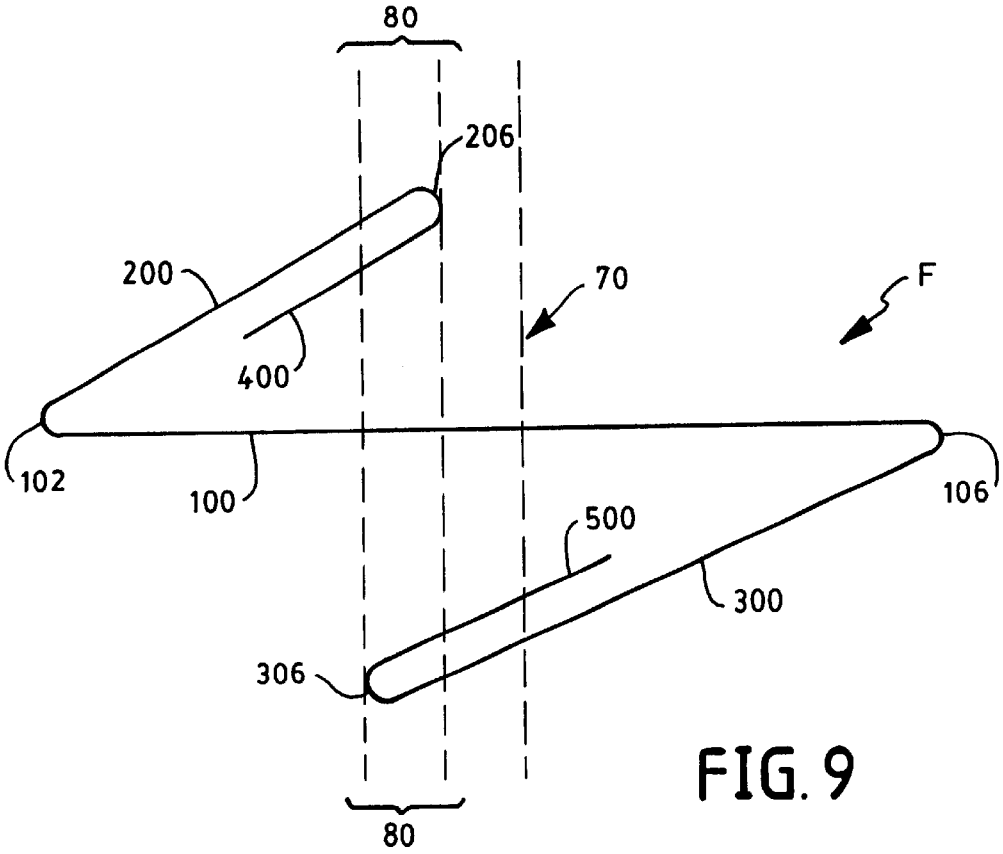
FIG. 9 is an illustration of a cross section of an exemplary individual folded web.
Figure 10:
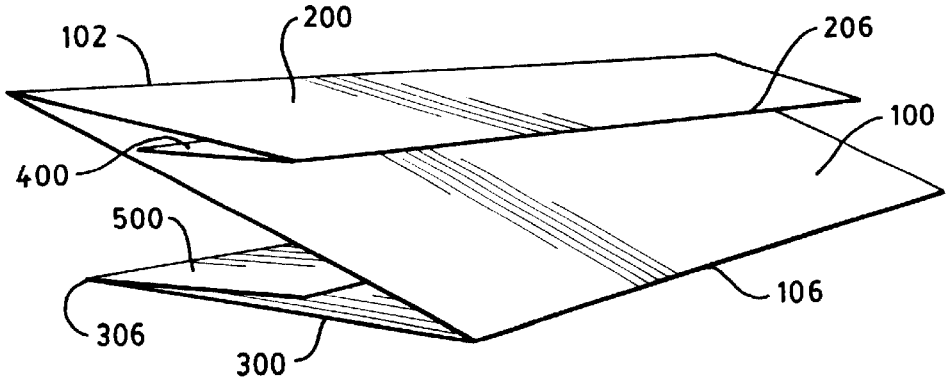
FIG. 10 is a perspective view of an exemplary individual folded web depicted in FIG. 9.

More particularly and with reference to FIG. 8, the folded web "F" includes a first, central panel 100 that has a first fold line 102 at a first end 104 and a second fold line 106 at a second end 108 that is opposite from the first end 104. The folded web "F", further includes a second panel 200 having a first end 202 that is joined with the first panel 100 at the first fold line 102 and a second end 204 having a third fold line 206 defined thereat. A third panel 300 having a first end 302 that is joined with the first panel 100 at the second fold line 106 further includes a second end 304 having a fourth fold line 306 defined thereat. The folded web "F" also includes a fourth panel 400 that is joined to the second panel 200 at the third fold line 206. The fourth panel 400 is folded with respect to the second panel 200 at the third fold line 206 so that fourth panel 400 is positioned substantially between the first panel 100 and the second panel 200. Similarly, the folded web "F" includes a fifth panel 500 that is joined to the third panel 300 at the fourth fold line 306. The fifth panel 500 is folded with respect to the third panel 300 at the fourth fold line 306 so that the fifth panel 500 will be positioned substantially between the third panel 300 and the first panel 100 when folded as shown in FIGS. 8, 9 and 10.

A first edge "E" of the folded web "F" is defined on an end of the fourth panel 400 that is opposite from the third fold line 206. Similarly, the folded web "F" includes a second edge "E'" that is on the fifth panel 500 and is positioned opposite from the fourth fold line 306. Since the fourth and fifth panels 400, 500 are folded so as to be between the second and third panels 200, 300, respectively, and the first panel 100, the first and second edges E, E' will not be readily visible to an observer.

An important feature of the present invention is that the combined width of the second and third panels 200, 300 are greater than the width of the first panel 100, which will insure that the web product "F" has a zone or region of non-uniform thickness extending across the length of the folded web product in a central region when the product is folded flat.

The width of the first panel 100 is defined as being the distance from the first fold line 102 to the second fold line 106. The width of the second panel 200 is defined as being the distance from the first fold line 102 to the third fold line 206, and the width of third panel 300 is defined as being the distance from the second fold line 106 to the fourth fold line 306.

Figure 11:
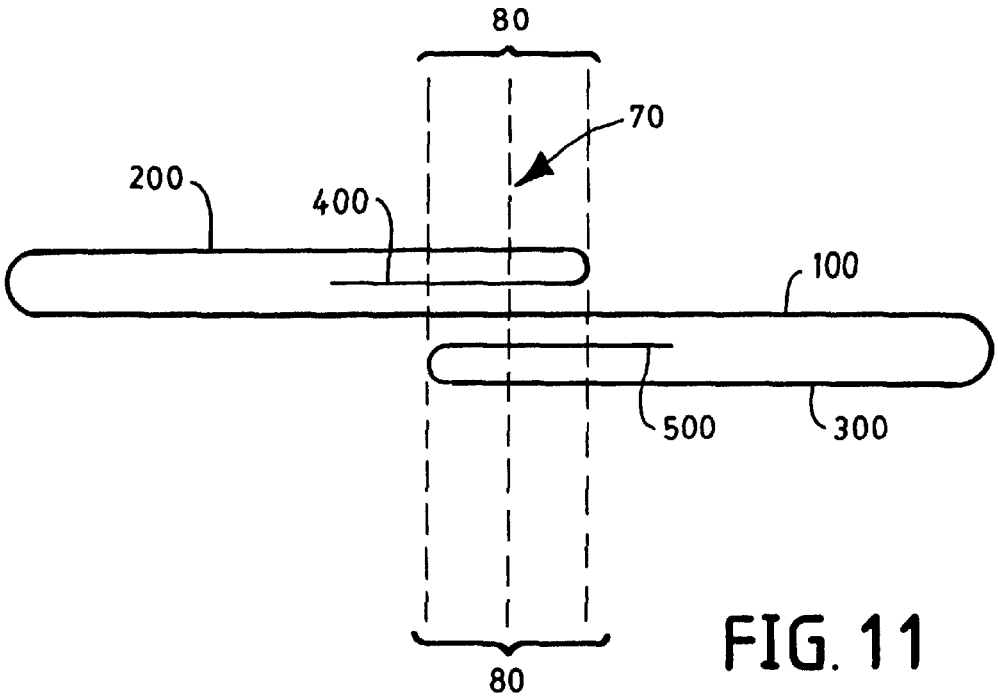
FIG. 11 is an illustration of a cross section of an exemplary individual folded web depicted in FIG. 8, shown in a compressed folded state.

A mid-point 70 of the distance on first panel 100 between first fold line 102 and second fold line 106 is indicated in FIGS. 8 and 11. In the embodiment of FIGS. 8, and 11, the second panel 200 and the third panel 300 have the same width which, in combination, is greater than the width of the first panel 100. This causes the third fold line 206 to be positioned on an opposite side of the mid-point 70 from first fold line 102 and the fourth fold line 306 to be positioned on the opposite side of the mid-point 70 from the second fold line 206. Such a configuration causes a portion of the second panel 200 and fourth panel 400 to overlap a portion of the third panel 300 and fifth panel 500 generating a zone or region 80 of non-uniform thickness across the length of the folded web "F". As can be seen in FIGS. 8 and 11, the zone or region 80 of non-uniform thickness is centered on the mid-point 70.

In the embodiment of FIG. 9, the second panel 200 has a width that is less than the width of the third panel 300. Importantly, the combined width of the second panel 200 and the third panel 300 is greater than the width of the first panel 100 so a portion of the second panel 200 and fourth panel 400 to overlap a portion of the third panel 300 and fifth panel 500 generating a zone or region 80 of non-uniform thickness across the length of the folded web "F". The lack of symmetry between the second panel 200 and the third panel 300 shifts the zone or region 80 of non-uniform thickness away from the mid-point 70. Such a configuration is desirable for dispensers having an offset opening.

According to an embodiment of the invention, the width of the fourth panel 400 may be less than one-half the width of the second panel 200. Alternatively and/or additionally, the width of the fifth panel 500 may be less than one-half the width of the third panel 300. Such a configuration enhances the difference in thickness (i.e., the non-uniform thickness) of the folded web product by concentrating the overlaying of the panels in the central region of the folded web product. For example, in the center of the folded web product, portions of the second panel 200, the fourth panel 400, the first panel 100, the fifth panel 500 and the third panel 300 will be stacked on over each other to provide a thickness equivalent to five (5) sheets of material. When the width of the fourth panel 400 is less than the second panel 200 (e.g., the fourth less than ½ the width of the second panel) and when the width of the fifth panel 500 is less than the third panel 300 (e.g., the fifth panel less than ½ the width of the third panel), the non-central regions or outer regions of the folded sheet product have a thickness equivalent to only two (2) sheets of material. Thus, the outer regions of the folded sheet product have a thickness that is less than one-half (i.e., ⅖) the thickness of the central region.

Figure 12:
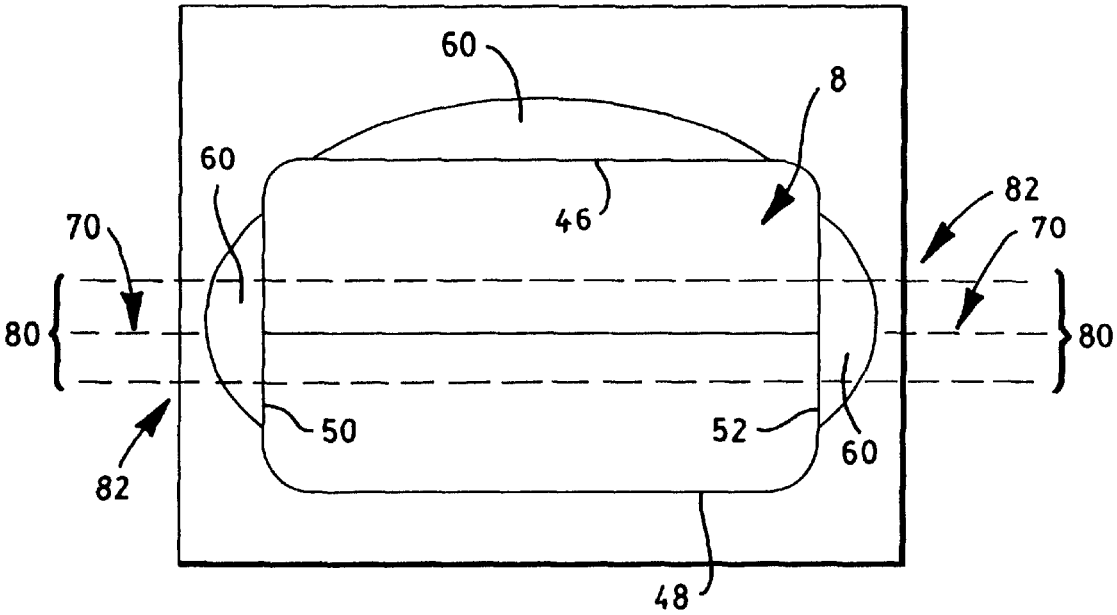
FIG. 12 is a front view illustration of a dispenser system for individual folded webs containing a stack of individual folded webs.

In the past, it was generally thought that folded web products should be configured to eliminate areas of non-uniform thickness. However, the configuration of non-uniform thickness in the present invention discussed above provides several advantages. Referring now to FIG. 12 of the drawings, there is shown a front view illustration of a dispenser _____26 containing an exemplary folded web product "F". According to a feature of the present invention, the zone or region 80 of non-uniform thickness (which is aligned generally at the mid-point 70 or at some offset from the mid-point 70) contacts only small, "centrally located" sections 82 of the dispenser instead of the entire upper edge 46 or lower edge 48 as with a conventional overfold type product.

Contact between the zone or region 80 of non-uniform thickness at only small, "centrally located" sections 82 of the dispenser helps to minimize the amount of area that can be pressed against face of the dispenser when it is spring-loaded or overfilled. It is generally thought that minimizing this area of contact (of the thickest portion of the stack of folded products) will help reduce friction between the spring-loaded or overfilled stack of folded web product so that sheets may be dispensed easily and reliably.

Another advantage of the zone or region 80 of non-uniform thickness at only the small, "centrally located" sections 82 of the dispenser is that the thinner sections of a stack of the dispensable folded web products are located at the upper and lower edges 30 of the dispenser. Since pressure on the stack of folded web products is focused at its thickest section (i.e., the zone or region 80 of non-uniform thickness) which contacts only a small portion of the dispenser, the thinner sections of the stack of web products which are in contact with a greater portion of the dispenser (i.e., the upper and lower edges 30) are subjected to substantially less pressure from spring-loading or overfilling.

Yet another advantage of the present invention is that the configuration of the zone or region 80 of non-uniform thickness causes that portion of a stack of folded web product to tend to "bow out", protrude, bulge, or project outward from the opening in the dispenser. This effect is greatly enhanced by placement of the recessed portions 60 at one or more edges of the dispensing throat. Since the zone or region is aligned generally at the mid-point 70 or at some offset from the mid-point 70, the bulge or projection generally makes it easier to grasp an individual folded sheet product.

The present invention had been found to be particularly desirable for use with horizontally placed individual folded paper napkin dispensers. The combination of a narrow dispensing throat, projecting dispensing face, stacking means and bumpers that bow out the napkins in a staging area provide reliable and less wasteful dispensing of the individual folded paper napkins. Of course, the dispensing system of the present invention may be used with vertically mounted dispensers such as, for example, vertically mounted napkin, tissue or towel dispensers.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A dispensing system for individual folded webs having an area of non-uniform thickness across the length of the web from a stack of such individual folded webs, the dispensing system comprising:

an outer housing defining an interior space;

stacking means mounted within the outer housing for holding a stack of individual folded webs within the interior space;

a dispensing face defined in the outer housing proximate to an end of the stacking means, the dispensing face having a central portion projecting out from the dispenser in the form of a first surface and a second surface joined at an obtuse angle and a dispensing throat located in the central portion at about the intersection of the first and second surfaces, said dispensing throat circumscribed by continuous edges within said central portion;

a stack of individual folded webs having an area of non-uniform thickness across the length of the web aligned so that an area of greatest thickness extends across the width of the dispensing throat; and at least one inwardly projecting recessed section along at least one said edge of the dispensing throat which contacts the stack of individual folded webs across an entire width of the area of non-uniform thickness so that a portion of the stack of individual folded webs projects outward from the dispensing throat.

2. The dispensing system of claim 1, wherein the stacking means comprises at least one restricting rib positioned against the stack of individual folded webs to maintain alignment of the stack so that the area of greatest thickness extends across the width of the dispensing throat during dispensing.

3. The dispensing system of claim 1, further comprising a staging area proximate the dispensing throat for spacing and slowing individual folded webs as they approach the dispensing throat.

4. The dispensing system of claim 3, wherein the staging area comprises at least two curved bumpers oriented so as to be parallel to the path of travel of the individual folded webs as they approach the dispensing throat, and a number of ribs defined on the bumpers for temporarily arresting movement of the individual folded webs as they approach the dispensing throat.

5. The dispensing system of claim 1, wherein the stack of individual folded webs is composed of individual webs comprising:

a first, central panel;

a second panel, unitary with said first panel and folded over a first side of said first panel;

a third panel, unitary with the first panel, and folded over a second side of the first panel;

a fourth panel, unitary with the second panel, and folded so as to be positioned between the first and second panels; and a fifth panel, unitary with the third panel, and folded so as to be positioned between the first and third panels, wherein a portion of the third panel and fifth panel overlap a portion of the second panel and fourth panel generating an area of non-uniform thickness across the length of the web.

6. The dispensing system of claim 5, wherein the stack of individual folded webs is a stack of paper napkins.

7. A dispensing system for individual folded webs having an area of non-uniform thickness across the length of the web from a stack of such individual folded webs, the dispensing system comprising:

an outer housing defining an interior space;

stacking means mounted within the outer housing for holding a stack of individual folded webs within the interior space;

a dispensing face defined in the outer housing proximate to an end of the stacking means, the dispensing face having a central portion projecting out from the dispenser in the form of a first surface and a second surface joined at an obtuse angle and a dispensing throat located in the central portion at about the intersection of the first and second surfaces, the dispensing throat having a top edge, a bottom edge, a first side edge and a second side edge;

a stack of individual folded webs having an area of non-uniform thickness across the length of the web aligned so that an area of greatest thickness extends across the width of the dispensing throat; and recessed sections along the top edge, first side edge, and second side edge of the dispensing throat which contact the stack of individual folded webs across an entire width of the area of non-uniform thickness so that a portion of the stack of individual folded webs projects outward from the dispensing throat.

8. The dispensing system of claim 7, wherein the stacking means comprises at least one restricting rib positioned against the stack of individual folded webs to maintain alignment of the stack so that the area of greatest thickness extends across the width of the dispensing throat during dispensing.

9. The dispensing system of claim 7, further comprising a staging area proximate the dispensing throat for spacing and slowing individual folded webs as they approach the dispensing throat.

10. The dispensing system of claim 9, wherein the staging area comprises at least two curved bumpers oriented so as to be parallel to the path of travel of the individual folded webs as they approach the dispensing throat, and a number of ribs defined on the bumpers for temporarily arresting movement of the individual folded webs as they approach the dispensing throat.

11. The dispensing system of claim 7, wherein the stack of individual folded webs is composed of individual webs comprising:

a first, central panel;

a second panel, unitary with said first panel and folded over a first side of said first panel;

a third panel, unitary with the first panel, and folded over a second side of the first panel;

a fourth panel, unitary with the second panel, and folded so as to be positioned between the first and second panels; and a fifth panel, unitary with the third panel, and folded so as to be positioned between the first and third panels, wherein a portion of the third panel and fifth panel overlap a portion of the second panel and fourth panel generating an area of non-uniform thickness across the length of the product.

12. The dispensing system of claim 11, wherein the stack of individual folded webs is a stack of paper napkins.

13. A dispensing system for individual folded webs having an area of non-uniform thickness across the length of the web from a stack of such individual folded webs, the dispensing system comprising:

an outer housing defining an interior space;

stacking means mounted within the outer housing for holding a stack of individual folded webs within the interior space;

a dispensing face defined in the outer housing proximate to an end of the stacking means, the dispensing face further comprising:

a central portion projecting out from the outer housing in the form of a first surface and a second surface joined at an obtuse angle;

a dispensing throat located in the central portion at about the intersection of the first and second surfaces and bisected by the obtuse angle, the dispensing throat circumscribed by continuous edges within said central portion;

a stack of individual folded webs having an area of non-uniform thickness across the length of the web aligned so that an area of greatest thickness extends across the width of the dispensing throat; and at least one inwardly projecting recessed section along at least one said edge of the dispensing throat which contacts the stack of individual folded webs so that a portion of the stack of individual folded webs projects outward from the dispensing throat.

14. The dispensing system of claim 13 wherein the at least one inwardly projecting recessed section is adapted to contact the stack of individual folded webs across a portion of the non-uniform thickness and bow the individual folded webs outward from the dispensing throat.

15. The dispensing system of claim 13 wherein the oblique angle ranges from about 160 degrees to about 175 degrees.

16. The dispensing system of claim 13 further comprising two inwardly projecting recessed sections located at side edges of the dispensing throat.

17. The dispensing system of claim 16 further comprising an additional inwardly projecting recessed section located at a top edge of the dispensing throat.

18. A dispensing system for individual folded webs having an area of non-uniform thickness across the length of the web from a stack of such individual folded webs, the dispensing system comprising:

a stack of individual folded webs having a length and a width, further having an area of non-uniform thickness across the length;

an outer housing defining an interior space;

stacking means mounted within the outer housing for holding the stack of individual folded webs within the interior space;

a dispensing face defined in the outer housing proximate to an end of the stacking means, the dispensing face further comprising:

a central portion projecting out from the outer housing in the form of a first surface and a second surface joined at an obtuse angle;

a dispensing throat located in the central portion at about the intersection of the first and second surfaces, the dispensing throat having a top, bottom, and side edges; and recessed portions located at the side edges directed inwardly toward the interior space of the outer housing for contacting the stack of individual folded webs across a portion of the non-uniform thickness and bowing the individual folded webs outward from the dispensing throat.

19. The dispensing system of claim 18 wherein about one half of the area comprising the dispensing throat is located in the first surface and the remaining area comprising the dispensing throat is located in the second surface.

20. The dispensing system of claim 18 wherein the oblique angle ranges from about 160 degrees to about 175 degrees.

* * * * *